US006807773B2

(12) United States Patent
Cardine et al.

(10) Patent No.: US 6,807,773 B2
(45) Date of Patent: Oct. 26, 2004

(54) DOOR WITH ADJUSTABLE GUIDE RAIL AND CORRESPONDING METHOD OF ASSEMBLY

(75) Inventors: Patrice Cardine, Orleans (FR); Denis Chevy, Neuvy en Sullias (FR)

(73) Assignee: ArvinMeritor Light Vehicle Systems - France (FR)

( * ) Notice: Subject to any disclaimer, the term of this patent is extended or adjusted under 35 U.S.C. 154(b) by 28 days.

(21) Appl. No.: 10/340,039

(22) Filed: Jan. 10, 2003

(65) Prior Publication Data

US 2003/0131534 A1 Jul. 17, 2003

(30) Foreign Application Priority Data

Jan. 11, 2002 (FR) ..... 02 00304

(51) Int. Cl.[7] ..... E06B 7/20
(52) U.S. Cl. ..... 49/212; 49/348
(58) Field of Search ..... 49/209, 212, 348, 49/349, 352, 502

(56) References Cited

U.S. PATENT DOCUMENTS 3,273,285 A 9/1966 Champion
3,844,064 A 10/1974 Yamaha et al.
4,845,894 A * 7/1989 Herringshaw et al. ..... 49/502
4,956,942 A 9/1990 Lisak et al.
5,632,121 A 5/1997 Handte et al.
5,855,095 A * 1/1999 Dedrich et al. ..... 49/502
5,867,942 A * 2/1999 Kowalski ..... 49/502
5,960,588 A 10/1999 Wurm et al.

FOREIGN PATENT DOCUMENTS

WO WO 98/16709 4/1998

* cited by examiner

*Primary Examiner*—Jerry Redman
(74) *Attorney, Agent, or Firm*—Carlson, Gaskey & Olds

(57) ABSTRACT

A window lifter includes at least one panel, a rail for guiding a slider, and a lower attachment of the lower end of the rail to the panel able selectively to cause the rail to slide transversely with respect to the panel, and a one-piece upper attachment of the upper end of the rail to the panel able to cause the upper end of the rail to pivot with respect to the panel about a longitudinal axis. The window lifter makes it possible to reduce the number of parts in a window lifter and makes it easier to assemble.

18 Claims, 2 Drawing Sheets

DOOR WITH ADJUSTABLE GUIDE RAIL AND CORRESPONDING METHOD OF ASSEMBLY

This application claims priority to French Patent Application 02 00 304 filed Jan. 11, 2002.

BACKGROUND OF THE INVENTION

The invention relates to car doors and window lifters, and in particular to doors and window lifters of cabriolets or convertibles.

Cabriolets are known, in particular the vehicle marketed by Peugeot under the name Peugeot 206CC, in which the door has no window surround. In this case, it is then particularly important to be able to adjust the position of the top of the window by a few millimeters in the transverse direction of the vehicle. This adjustment makes it possible to obtain a good seal at the periphery of the door window and to compensate for assembly spread.

Peugeot markets a vehicle under the name Peugeot 206CC equipped with a door window lifter that has a rail adjustable in the transverse direction. The window lifter includes two rails extending vertically inside a front door. These rails have a slider guide groove. Each rail has an upper attachment and a lower attachment with the door or the chassis. The lower attachment allows the lower part of the rail to be moved in the transverse direction of the vehicle. The upper attachment is rigid.

That device has disadvantages. Specifically, when the window lifter is being assembled with the door, the transverse movement of the lower part of the rail during the adjusting step causes the rail to pivot under stress about a longitudinal axis of the vehicle, the axis lying approximately at the upper fixing. Because of the fixedness of the upper attachment, the transverse position of the window is thus adjusted by forcing it, and this generates deformation in the geometry of the rail and/or of the door. This deformation is the seat or poor window lifter adjustment efficiency. In addition, this device requires a significant movement of the lower part of the rail, and therefore significant deformation of the rail, to allow the top of the window to be adjusted by a small amount.

Alfa Romeo markets a vehicle under the name of The Spider. The door of this vehicle has no window surround. This door is equipped with a window lifter with a sector-arm and two guide rails which are adjustable in the transverse direction. The window lifter includes two rails running vertically inside a front door. These rails have a slider guide groove. Each rail has an upper attachment and a lower attachment with the door or the chassis. The lower attachment allows the lower part of the rail to be moved in the transverse direction of the vehicle. The upper attachment of each rail includes of a lug for fixing to the door, a lug for fixing to the rail, and a rivet articulating the two lugs. The rivet allows pivoting about a longitudinal axis of the vehicle when the lower attachment is moved in the transverse direction.

That device also has disadvantages. In particular, that device includes many parts, which means an expensive and complicated assembly.

There is therefore a need for a window lifter which solves one or more of these problems.

SUMMARY OF THE INVENTION

The subject of the invention is thus a window lifter including at least one panel, a rail for guiding a slider, a lower attachment of the lower end of the rail to the panel to selectively cause the rail to slide transversely with respect to the panel, and a one-piece upper attachment of the upper end of the rail to the panel able to cause the upper end of the rail to pivot with respect to the panel about a longitudinal axis.

In an alternative form, the upper attachment of the upper end of the rail has a panel-fixing part and a rail-fixing part that can pivot with respect each other.

According to another alternative form, the panel-fixing part or the rail fixing part have a reinforcement. The reinforcements can include a transversely directed rib.

According to an alternative form, the upper attachment has a region that joins the rail-fixing part and the panel-fixing part, and the cross section of the region is smaller than the mean section of the panel-fixing and rail-fixing parts. The upper attachment can be one-piece with the rail-fixing part.

According to another alternative form, the upper attachment has a predeformation to allow pivoting. Alternately, the redeformation can be obtained by pressing.

The window lifter can further include a cable turn element fixed to the rail-fixing part. The window lifter can also further include an element for receiving an end of a cable sheath of one piece with the rail fixing part.

BRIEF DESCRIPTION OF THE DRAWINGS

Other features and advantages of the invention will become apparent from reading the description which follows of some embodiments of the invention, which description is given merely by way of example with reference to the appended drawings which show.

DETAILED DESCRIPTION OF THE PREFERRED EMBODIMENT

The invention provides a window lifter equipped with a lower attachment sliding transversely and an upper attachment having, one-piece, a rail-fixing part and a panel-fixing part. The rail-fixing and panel-fixing parts can pivot with respect to each other. This result is obtained in particular by using rail-fixing and panel-fixing parts which are more rigid than the region which joins them.

In the description which follows, the transverse direction corresponds to the normal to the mean plane of the door or of a lateral bodywork panel as appropriate. The longitudinal and vertical directions correspond to the longitudinal and vertical directions of the vehicle in which the window lifter is mounted.

Figure 1:
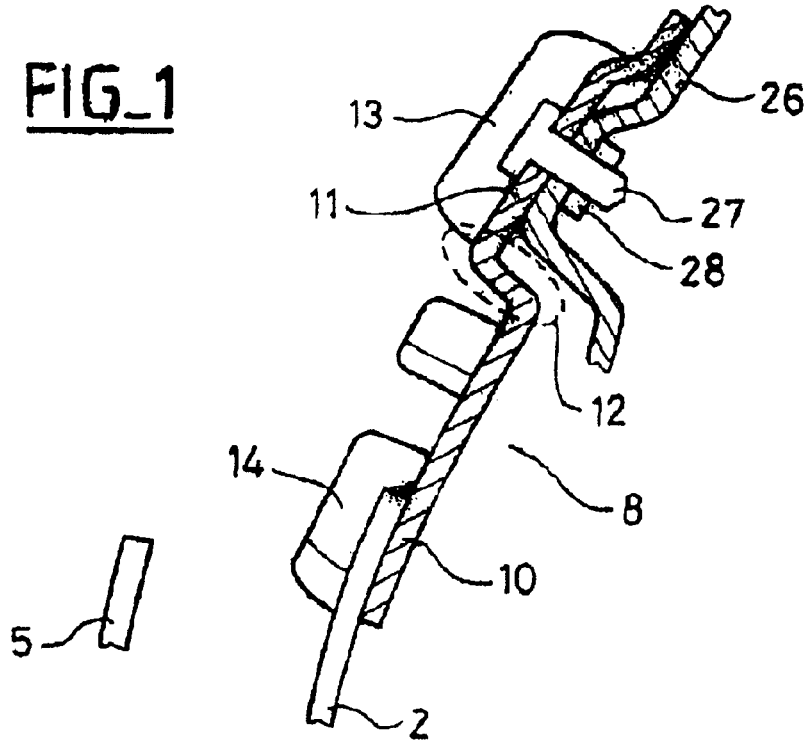
FIG. 1 illustrates a sectional depiction of a window lifter according to the invention.
Figure 1:
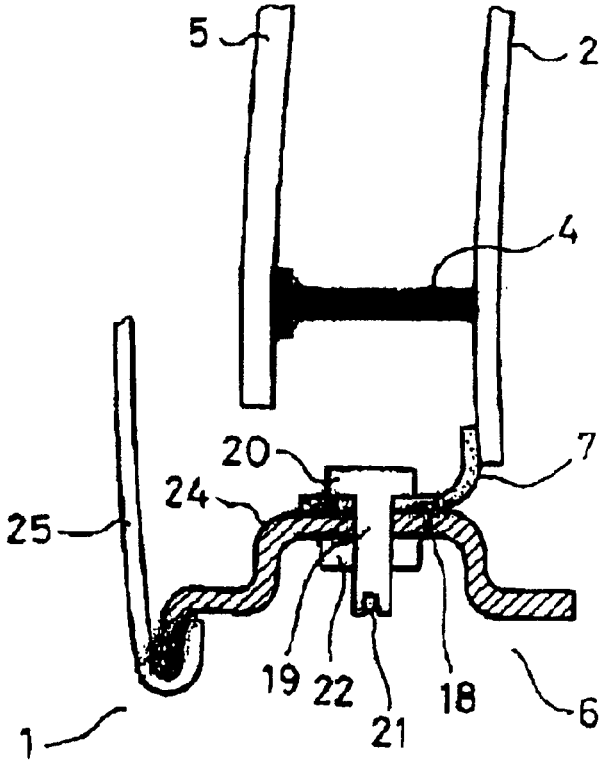

FIG. 1 shows a window lifter 1 according to the invention including a window lifter rail 2 having a guide groove (not depicted) for a slider 4. The guide groove allows the slider 4 to slide upwardly and downwardly. The slider 4 is secured to a window glass 5. The window lifter 1 has a lower attachment 6 of the lower end of the rail 2 to an outer panel 25. Of course, provision could be made for the lower attachment 6 to provide the connection between the rail 2 and an inner panel or a structural element 26 in place of or in addition to the outer panel 25. The window lifter 1 also has an upper attachment 8 of an upper end of the rail 2 to an inner panel or to a structural element 26 of the door or of the vehicle. This may, for example, be an attachment of the rail 2 to the upper edge of the door. The reference 26 hereinafter will denote an inner panel, for tho purposes of simplification.

The lower attachment 6 allows the rail 2 to slide in the transverse direction. The sliding allows the transverse position of the top of the window glass 5 to be altered. One example of an attachment allowing the rail 2 to slide with respect to the panel will be detailed later on.

Figure 2:
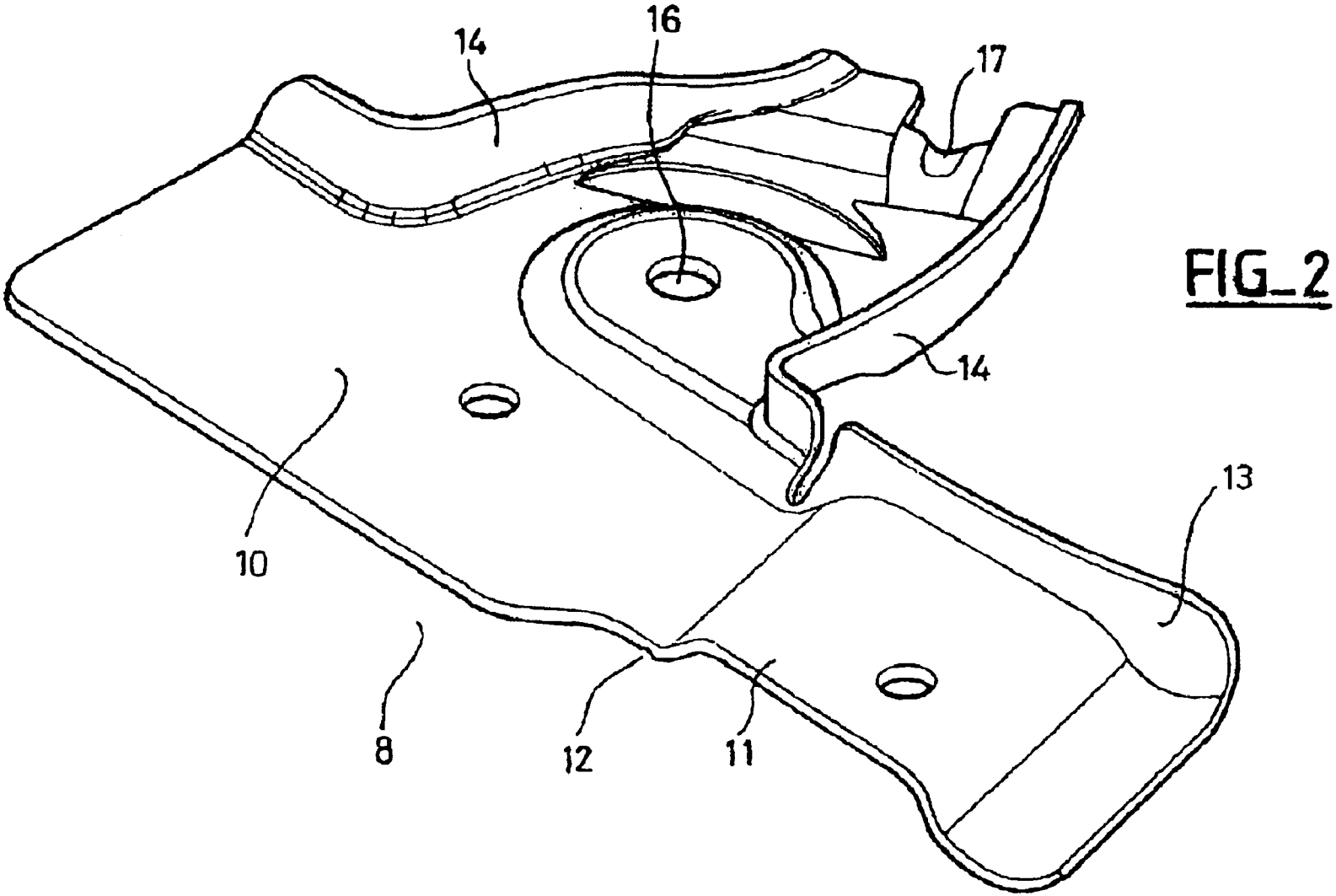
FIG. 2 illustrates a perspective depiction of an attachment of the upper end of the rail to a panel.

FIG. 2 is a perspective view of the upper attachment 8. The upper attachment 8 of the upper end of the rail 2 has a rail-fixing part 10 and a panel-fixing part 11. The panel-fixing part 11 is fixed, in the example by a screw 27 and a nut 28, to the inner panel 26. Of course, any other type or fixing, such as welding, riveting or some other type of screwing may be employed. The rail-fixing part 10 is fixed to the guide rail 2, possibly by welding or by any other appropriate means, or is of one piece with the rail 2. The two parts 10 and 11 depicted are thus of one piece. The rail-fixing part 10 may also be of one piece with the rail 2, advantageously when a pressed rail 2 is used. The number of elements in the window lifter 1 is thus reduced. The cost of the pans and of assembling the window lifter 1 is thus reduced. These two parts are also able to pivot one with respect to the other about a longitudinal axis. Thus, when the lower end of the rail 2 is moved transversely, the upper part of the rail 2 can pivot with respect to the inner panel 26 without leading to deformation of the rail 2. For a given displacement of the lower end of the rail 2, the transverse displacement of the upper end of the window glass 5 is also greater because of the pivoting about the longitudinal axis between the rail-fixing and panel-fixing parts 10 and 11.

When the rail-fixing and panel-fixing parts 10, 11 are fixed to the rail 2 and to the inner panel 26, the pivoting between the rail-fixing part 10 and the panel-fixing part 11 is blocked by the preventing of the lower attachment 6 from moving translationally.

As depicted, the fixing parts 10 and 11 each have a part which is roughly flat and parallel to the window glass 5. The pivoting between the rail-fixing and panel-fixing parts 10, 11 is afforded, in the example, by means of a predeformation of the material of the attachment. This predeformation is, for example, achieved by pressing. The joining region 12, outlined in dotted lines, of the upper attachment 8 is thus a region that is predeformed by pressing. The joining region 12 thus has a cross section, in a plane containing the transverse and vertical axes, that is curved. The pivoting may thus be afforded by plastic or elastic deformation of the upper attachment 8 in this region, depending on the materials and on the geometry of the upper attachment 8. Furthermore, such a predeformed joining region 12 also has a good ability to withstand force in the transverse direction.

The pivoting between the fixing parts 10 and 11 may also be possible by thinning the joining region 12 that joins the rail-fixing region 10 and the panel-fixing region 11. The upper attachment 8 therefore has joining region 12 that joins the rail-fixing part 10 and the panel-fixing part 11, and the cross-section of the joining region 12 is smaller than the mean section of the rail-fixing and panel-fixing parts 10, 11. This alternative form is particularly advantageous when the upper attachment 8 has a roughly flat joining region 12 between the fixing parts 10, 11.

The panel-fixing part 11 preferably has a reinforcement. This reinforcement allows the pivoting deformations of the upper attachment 8 to be concentrated into the joining region 12. In cases where the window lifter 1 is mounted in a door, the reinforcement allows the upper attachment 8 to withstand forces in the transverse direction. These forces are particularly high when the door is being closed. The reinforcement of the panel-fixing part 11 is, for example, produced in the form of a transversely directed rib 13. Such a form is particularly suitable when the upper attachment 8 is made by stamping a metal sheet. The rib 13 preferably extends along a plane perpendicular to the longitudinal direction. The panel-fixing part 11 thus flexes less about the longitudinal axis when loaded.

The rail-fixing part 10 may also have a reinforcement 14 that also allows the deformations of pivoting of the upper attachment 8 to be concentrated into the joining region 12. The pivoting between the fixing parts 10 and 11 can thus be achieved with less deformation of the fixing parts 10 and 11 and of the rail 2.

Alternately a cable turn element of a type known per se is fixed to the rail-fixing part. It is preferable for such a turn element to be fixed to the rail-fixing part 10. As the rail-fixing part 10 is secured to the rail 2, the cabling of the window lifter 1 will be practically uninfluenced by the adjustment of the position of the rail 2 of the window lifter 1. The upper attachment 8 may thus have a bore 16 for fixing the turn element or a shaft of a turn pulley.

The upper attachment 8 may also have an element 17 for receiving one end of a cable sheath. The receiving element 17 may have a stop for the end of the sheath and a cable passage next to the stop.

A detailed example of the lower attachment 6 of a rail 2 will now be described. The lower attachment 6 is made, for example, by means of a lug 7 fixed to the rail 2 and of a bridge 24. The lug 7 is arranged approximately at right angles to the rail 2. The lug 7 has an oblong hole 18 extending in the transverse direction of the door or of the chassis, as appropriate. A double-headed screw 19 is inserted into the oblong hole 18. The screw 19 has an upper head 20 and a lower head 21. The thread of the screw is inserted into a screw thread of a corresponding nut 22. The nut 22 is fixed by welding to the bridge 24. The bridge 24 is preferably made in the bottom of the door, in the region where the lower end of the rail 2 is to be situated. The nut 22 is fixed to a flat surface or to a plate of the bridge 24.

The lug 7 may, for example be produced in a fold of the sheet metal of the guide rail 2 or with an attached and welded part, as appropriate. The upper surface of the lug 7 forms a bearing surface for the upper screw head 20 so the screw head 20 can apply a compression force to the lug 7. The underside of the lug 7 forms a bearing surface that contacts a corresponding surface of the bridge 24.

The oblong hole 18 allows the guide to be slid transversely with respect to the screw 19 during adjustment. Thus, when the screw 19 is held in place without being tightened, the lug 7 is free to slide to fix the transverse position of the rail 2 with respect to the outer panel 25. The transverse position of the window glass 5 can therefore be altered in this way.

When a tightening force is applied between the nut 21 and the screw 19, the contacting surfaces of the bridge 24 and of the lug 2, respectively, are immobilized by friction. It is also possible to anticipate immobilizing the surfaces of the bridge 24 and of the lug 7, respectively, using appropriate stops if the friction force between the bridge 24 and the lug 7 proves to be insufficient.

Of course, the present invention is not restricted to the examples and embodiments described and depicted but can be varied in numerous ways accessible to those skilled in the art. Thus, the invention is not restricted to a metal attachment of the upper end of the rail. The assembly of this attachment to the rail and to a panel may also be achieved in any appropriate way, according to the respective materials selected for the rail, the panel or this attachment, without departing from the scope of the invention.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A window lifter comprising:

an inner panel and an outer panel;

a rail for guiding a slider, the rail including a lower end and an upper end;

a lower attachment that attaches the lower end of the rail to the outer panel to selectively allow the rail to slide transversely with respect to the outer panel;

an upper attachment that attaches the upper end of the rail to the inner panel to allow the upper end of the rail to pivot with respect to the inner panel about axis;

wherein the upper attachment includes a rail-fixing part fixed to the rail, a panel-fixing part fixed to the inner panel, and a joining region that joins the rail fixing part and the panel-fixing part; and wherein a cross-section thickness of the joining region is less than a mean-cross section thickness of the panel fixing part and the rail-fixing part.

2. The window lifter of claim 1, wherein the the rail-fixing part is pivotable with respect to the panel-fixing part.

3. The window lifter of claim 2, wherein the panel-fixing part includes a reinforcement.

4. The window lifter of claim 3, wherein the reinforcement is defined by a transversely directed rib.

5. The window lifter of claim 2, wherein the panel-fixing part includes a flat region substantially parallel to the panel.

6. The window lifter of claim 5, wherein the panel-fixing part includes a flat region substantially parallel to the panel.

7. The window lifter of claim 2, further comprising a cable turn element fixed to the rail-fixing part of the upper attachment.

8. The window lifter of claim 2, wherein the rail-fixing part includes an element that receives an end of a cable sheath.

9. The window lifter of claim 1, wherein the rail-fixing part includes a reinforcement.

10. The window lifter of claim 9, wherein the reinforcement is defined by a transversely directed rib.

11. The window lifter of claim 1, wherein the upper attachment includes a predeformation to allow pivoting.

12. The window lifter of claim 11, wherein the predeformation is obtained by pressing.

13. The window lifter of claim 1, wherein the upper attachment is integral with the rail.

14. The window lifter of claim 1, wherein the rail-fixing part and the panel-fixing part are integral.

15. The window lifter of claim 1, wherein the panel-fixing part is substantially parallel to the rail-fixing part.

16. A window lifter comprising:

an inner panel and an outer panel;

a rail for guiding a slider, the rail including a lower end and an upper end;

a lower attachment that attaches the lower end of the rail to the outer panel to selectively allow the rail to slide transversely with respect to the outer panel;

an upper attachment that attaches the upper end of the rail to the inner panel to allow the upper end of the rail to pivot with respect to the inner panel about an axis;

wherein the upper attachment includes a rail-fixing part fixed to the rail having a rail transversely directed rib, a panel-fixing part fixed to the inner panel and having a panel transversely directed rib, and a joining region that joins the rail-fixing part and the panel-fixing part; and wherein a cross-section thickness of the joining region is less than a mean-cross section thickness of the panel fixing part and the rail-fixing part, and the rail-fixing part and the panel-fixing part are integral and pivotable with respect to each other.

17. The window lifter of claim 1, further comprising a cable turn element fixed to the rail-fixing part of the upper attachment.

18. The window lifter of claim 16, wherein the rail-fixing part includes an element that receives an end of a cable sheath.

* * * * *

UNITED STATES PATENT AND TRADEMARK OFFICE

CERTIFICATE OF CORRECTION

PATENT NO. : 6,807,773 B2
APPLICATION NO. : 10/340039
DATED : October 26, 2004
INVENTOR(S) : Cardine et al.

It is certified that error appears in the above-identified patent and that said Letters Patent is hereby corrected as shown below:

In Claim 1, Column 5, Line 26 of the issued patent, please insert --an-- after "about" and before "axis".

In Claim 1, Column 5, Line 29 of the issued patent, "rail fixing" should be --rail-fixing--.

In Claim 17, Column 6, Line 39 of the issued patent, "claim 1" should read as --claim 16--.

Signed and Sealed this

Fifth Day of June, 2007

JON W. DUDAS
*Director of the United States Patent and Trademark Office*